US007679595B2

(12) United States Patent
Luo et al.

(10) Patent No.: US 7,679,595 B2
(45) Date of Patent: Mar. 16, 2010

(54) IMAGE STICKING PREVENTION CIRCUIT FOR DISPLAY DEVICE

(75) Inventors: Ping Luo, Hsinchu (TW); Chien-Chih Chen, Jhudong Township (TW)

(73) Assignee: TPO Displays Corp., Chu-nan (TW)

( * ) Notice: Subject to any disclaimer, the term of this patent is extended or adjusted under 35 U.S.C. 154(b) by 1264 days.

(21) Appl. No.: 11/193,855

(22) Filed: Jul. 29, 2005

(65) Prior Publication Data

US 2006/0022971 A1 Feb. 2, 2006

Related U.S. Application Data

(63) Continuation-in-part of application No. 10/960,634, filed on Oct. 7, 2004, now Pat. No. 7,602,364.

(60) Provisional application No. 60/592,757, filed on Jul. 30, 2004.

(51) Int. Cl.
*G09G 3/36* (2006.01)

(52) U.S. Cl. ..... 345/98; 345/100; 345/204

(58) Field of Classification Search ..... 345/98, 345/100, 82, 211, 204, 92
See application file for complete search history.

(56) References Cited

U.S. PATENT DOCUMENTS 5,945,970 A 8/1999 Moon et al.
6,064,360 A 5/2000 Sakaedani et al.
6,529,257 B1 3/2003 Nakano
6,590,411 B2 7/2003 Lee
7,109,965 B1 9/2006 Lee et al.
7,187,392 B2 3/2007 Ito

FOREIGN PATENT DOCUMENTS

JP 01-170986 7/1989
JP 09-269476 10/1997
JP 10-333642 12/1998
JP 2000-089193 3/2000
JP 2001-092416 4/2001

*Primary Examiner*—Kevin M Nguyen
(74) *Attorney, Agent, or Firm*—Liu & Liu

(57) ABSTRACT

An image sticking prevention circuit for a display. The image sticking prevention circuit comprises a diode, a first capacitor, a transistor, and a second capacitor. The first terminal of the diode is coupled to a first voltage terminal of a voltage converter. The first capacitor has a first terminal coupled to the second terminal of the diode and a second terminal coupled to a first fixed potential. The transistor has a first terminal coupled to the first terminal of the first capacitor, a second terminal coupled to the first terminal of the diode and the first voltage terminal of the voltage converter, and a third terminal coupled to a second voltage terminal of the voltage converter and a gate driver circuit. The second capacitor has a first terminal coupled to the third terminal of the transistor and a second terminal coupled to a second fixed potential.

15 Claims, 10 Drawing Sheets

IMAGE STICKING PREVENTION CIRCUIT FOR DISPLAY DEVICE

CROSS-REFERENCE TO RELATED APPLICATION

This application is a continuation-in-part of U.S. application Ser. No. 10/960,634, filed on Oct. 7, 2004, the entire disclosure of which being incorporated by reference herein in its entirety. This application claims the priority of provisional application 60/592,757, filed on Jul. 30, 2004.

BACKGROUND

The invention relates to an image sticking prevention circuit and, in particular, to an image sticking prevention circuit for a display power-off mode.

As shown in FIG. 1, a conventional liquid crystal display (LCD) 100 comprises a voltage converter 140, a gate driver circuit 110, a data driver circuit 120, and a pixel array 150. The pixel array 150 comprises a plurality of gate lines 112, a plurality of date lines 122, and a plurality of pixel driving circuits 130. The pixel driving circuit 130 comprises a driving transistor 132, a storage capacitor 134 and a liquid crystal cell 136. A gate and a source of the driving transistor 132 are respectively connected to one of the gate lines or data lines. When the gate drive circuit 110 raises a voltage of the gate line 112, the driving transistor 132 is turned on and a data signal on the data line 122 is transmitted to a drain of the driving transistor. Thereby, the data driver circuit 120 sends the data signal to the storage capacitor 134 via the data line 122 and the driving transistor 132. After the data signal is loaded into the storage capacitor 134, the gate driver circuit 110 decreases the voltage of the gate line 112 to its former level such that the liquid crystal cell 136 generates an image according to the data signal before the next data signal is loaded. However, when the LCD 100 enters a power-off mode, the data signal still remains in the storage capacitor 134, generating a residual image.

A conventional solution shifts the current to voltage (I-V) curve of the transistor 132 (as shown in FIG. 2) to the left such that a threshold voltage of the transistor 132 is close to 0V. Thus, the transistor 132 is turned on even if a gate voltage of the transistor 132 is close to 0V. As a result, the data signal stored in the storage capacitor 134 is released to the data line 122. Image sticking is thus prevented, but current leakage is a major concern due to the decreased threshold voltage.

SUMMARY

The present invention provides an improved image sticking prevention circuit for displays. The image sticking prevention circuit is operatively coupled to the gate drive circuit that controls a pixel transistor. The image sticking prevention circuit provides an output to the gate drive circuit so that the gate drive circuit can turn on the pixel transistor during absence of regular power input to the gate drive circuit during power-off mode. In one aspect of the present invention, the image sticking prevention circuit comprises a charge storage device, storing charges during presence of regular power input to the gate drive circuit during power-on mode, and releasing the stored charges during absence of absence of regular power input to the gate drive circuit during power-off mode.

An embodiment of an image sticking prevention circuit for a display power-off mode comprises a diode, a first capacitor, a transistor, and a second capacitor. The diode has a first terminal and a second terminal. The first terminal of the diode is coupled to a first voltage terminal of a voltage converter. The first capacitor has a first terminal coupled to the second terminal of the diode and a second terminal coupled to a first fixed potential. The transistor has a first terminal coupled to the first terminal of the first capacitor, a second terminal coupled to the first terminal of the diode and the first voltage terminal of the voltage converter, and a third terminal coupled to a gate driver circuit and a second voltage terminal of the voltage converter. The second capacitor has a first terminal coupled to the third terminal of the transistor and a second terminal coupled to a second fixed potential.

Also provided are an integrated circuit and a display, each comprising the disclosed image sticking prevention circuit.

The present invention provides an image sticking prevention circuit operatively coupled to a gate driver circuit and a voltage converter. When a display enters a power-off mode, a driving transistor is turned on by output voltage of the image sticking prevention circuit. Thus the residual charge stored in storage capacitors is released, preventing image sticking.

DETAILED DESCRIPTION

Figure 1:
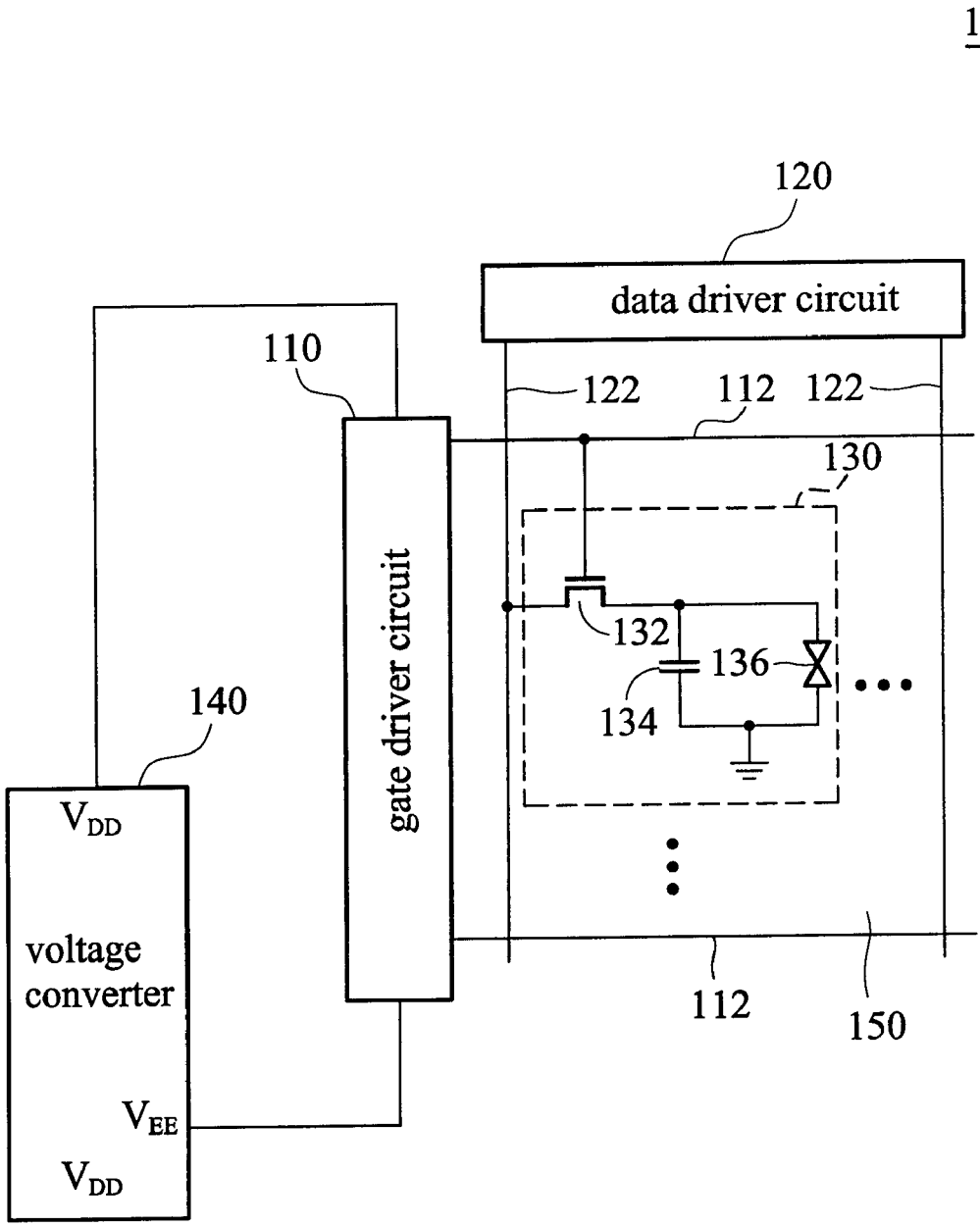
FIG. 1 (PRIOR ART)
FIG. 1 is a schematic diagram of a conventional liquid crystal display.
Figure 2:
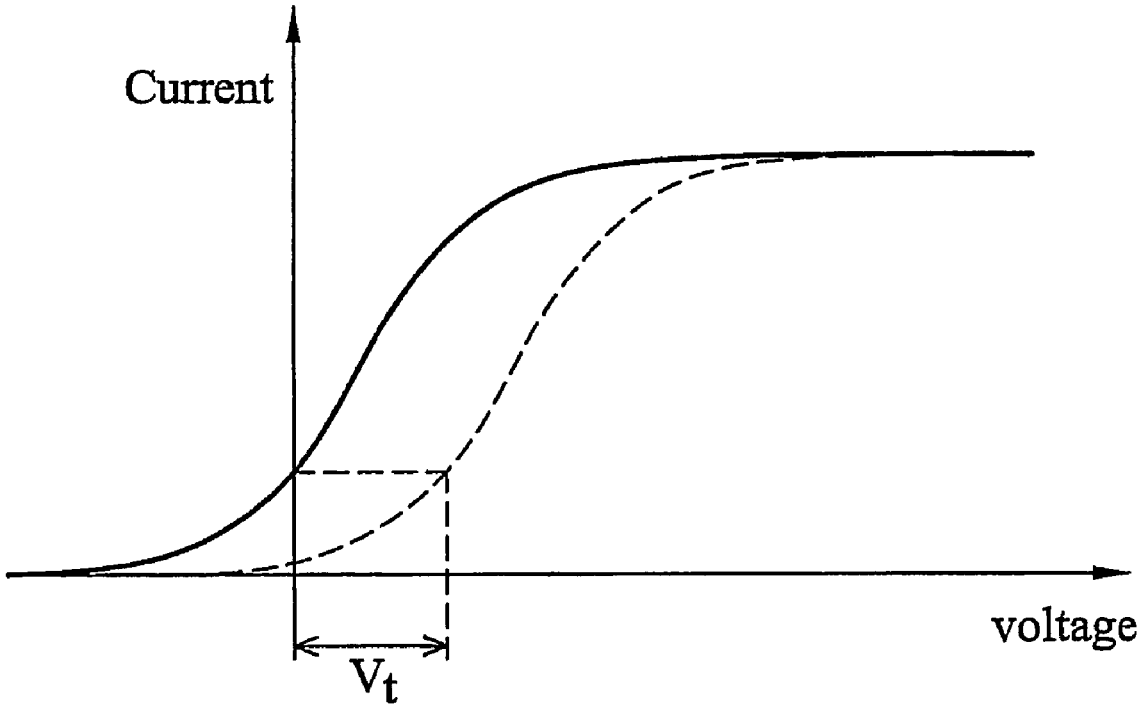
FIG. 2 shows a current to voltage (I-V) curve of a driving transistor in the liquid crystal display shown in FIG. 1.
Figure 3A:
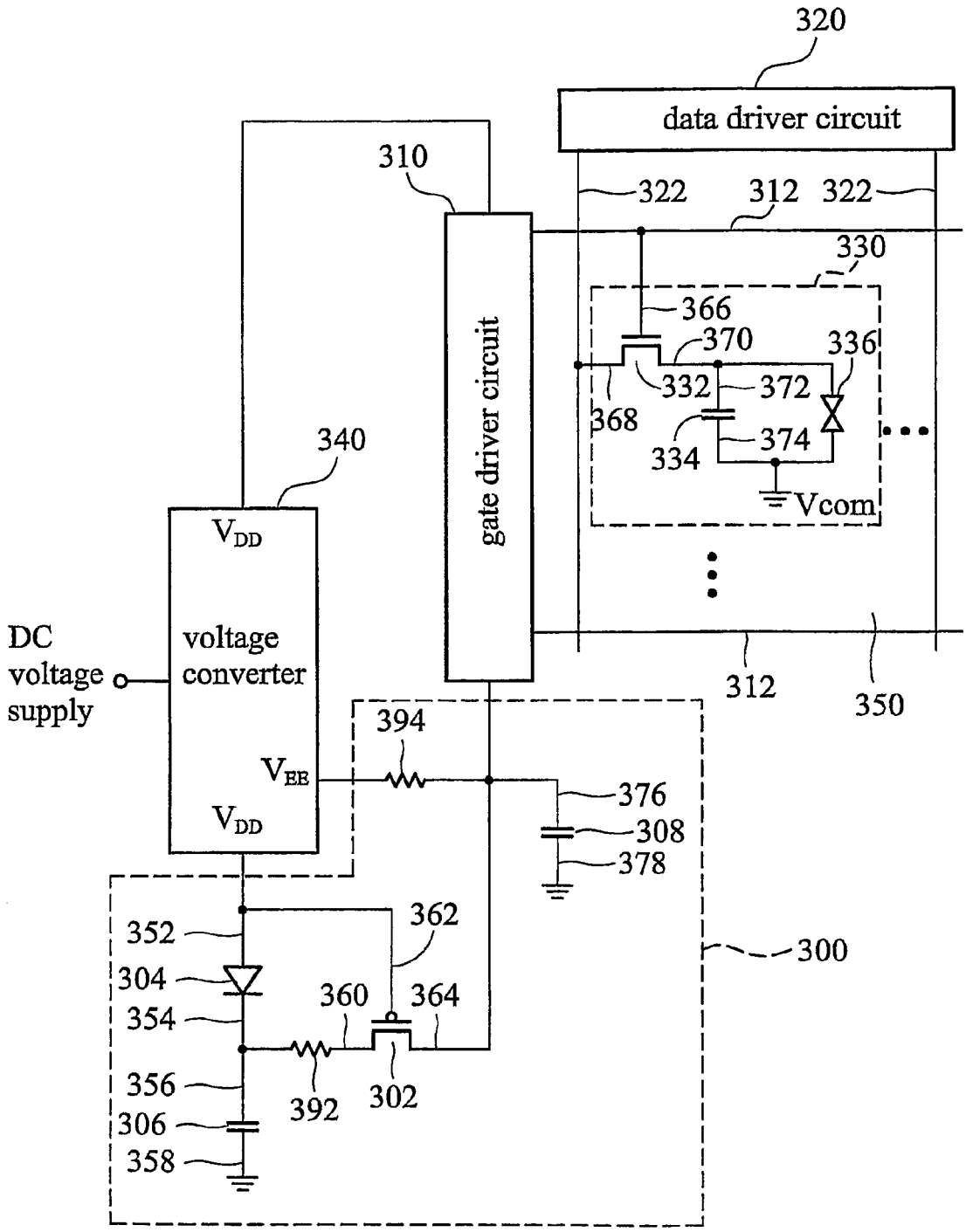
FIG. 3A is a schematic diagram of a liquid crystal display comprising an image sticking prevention circuit according to one embodiment of the invention.

Referring to FIG. 3A, an image sticking prevention circuit 300 is coupled to first and second voltage terminals ($V_{DD}$ and $V_{EE}$) of a voltage converter 340. Two terminals of a gate driver circuit 310 are coupled to the first voltage terminal ($V_{DD}$) and a second voltage terminal ($V_{EE}$) of the voltage converter 340, respectively. The pixel array 350 comprises a plurality of gate lines 312 and a plurality of data lines 322.

In addition, to facilitate the description of the present invention, the pixel driving circuit 330 is described first. In FIG. 3A, only one pixel driving circuit 330 is shown. Practically, there are a number of pixel driving circuits 330. In this embodiment, the pixel driving circuit 330 includes a driving transistor 332, a storage capacitor 334, and a liquid crystal cell 336. A gate 366 of driving transistor 332 is coupled to the gate line 312. A source 368 of the driving transistor 332 is coupled to the data line 322. A drain 370 of the driving transistor 332 is coupled to a first terminal 372 of the storage capacitor 334. A second terminal 374 of the storage capacitor 334 is coupled to a common voltage Vcom. One terminal of the liquid crystal cell 336 is coupled to the first terminal 372 of the storage capacitor 334. The other terminal of the liquid crystal cell 336 is coupled to the common voltage Vcom.

A power supply provides power to a voltage converter 340 and the voltage converter 340 provides the gate driver circuit 310 with a high voltage $V_{DD}$ and a low voltage $V_{EE}$. Preferably, the high voltage $V_{DD}$ is a positive voltage and the low voltage $V_{EE}$ is a negative voltage. For example, the high voltage $V_{DD}$ can be 12V, and the low voltage $V_{EE}$ −2V. When the data signal is received by the pixel driving circuit 330, the gate driver circuit 310 provides the high voltage $V_{DD}$ (12V) to turn on the driving transistor 332 via the gate line 312. After the driving transistor 332 is turned on, the data driver circuit 320 loads the data signal into the driving circuit 330 via the data line 322. After the data signal is loaded into the driving circuit 330, the gate driver circuit 310 provides the low voltage (−2V) to turn off the driving transistor 332. The data signal is stored in the storage capacitor 334 such that the liquid crystal cell 336 displays an image before the next data signal is loaded (i.e., the driving transistor 332 is turned on again). However, when the LCD enters a power-off mode, the data signal remains in the capacitor 334, generating a residual image.

Still referring to FIG. 3A, an embodiment of the present invention, the image sticking prevention circuit 300 comprises a diode 304, a first capacitor 306, a transistor 302, and a second capacitor 308. The diode has a first terminal 352 and a second terminal 354. The first terminal 352 of the diode is coupled to a first voltage terminal $V_{DD}$ of the voltage converter 340. The first capacitor 306 has a first terminal 356 coupled to the second terminal 354 of the diode 304 and a second terminal 358 coupled to a first fixed potential (for example, a ground as shown in FIG. 3A). The transistor 302 has a first terminal 360 coupled to the first terminal 356 of the first capacitor 306, a second terminal 362 coupled to the first terminal 352 of the diode 304 and the first voltage terminal $V_{DD}$ of the voltage converter 340, and a third terminal 364 coupled to a gate driver circuit 310 and a second voltage terminal $V_{EE}$ of the voltage converter 340. The second capacitor 308 has a first terminal 376 coupled to the third terminal 364 of the transistor 302 and a second terminal 378 coupled to a second fixed potential (for example, a ground as shown in FIG. 3A). Since the second capacitor 308 is coupled to the second fixed potential, the voltage of the second terminal $V_{EE}$ of the voltage converter 340 is stabilized and the driving capability thereof is thus improved. The second voltage terminal $V_{EE}$ of the voltage converter 340 is coupled to a resistor 394. It is noted that in FIG. 3A, the transistor 302 is a PMOS transistor, the first terminal 352 of the diode 304 is an anode, and the driving transistor 332 in the pixel driving circuit 330 is an NMOS transistor.

When the pixel array 350 enters a power-off mode, a gate voltage of the second terminal 362 of the transistor 302 is close to 0V. Thus, the transistor 302 is turned on. The first capacitor 306 releases the charge stored therein when the transistor 302 is turned on such that the voltage level of the gate line 312 is raised. As a result, the driving transistor 332 is turned on and the storage capacitor 334 releases the charge stored therein to the data line 322, with image sticking thereby prevented.

In the embodiment, arrangement of the diode 304 prevents current from flowing back to the first voltage terminal $V_{DD}$ Of the voltage converter 340. That is, when the first capacitor 306 discharges, the current flows only through the transistor 302 but not through the diode 304.

Furthermore, a large resistor 392 can be coupled between the first terminals 360 of the transistor 302 and the first voltage terminal $V_{DD}$ of the voltage converter 340 to prevent the transistor 302 from damage by a large current.

The image sticking prevention circuit 300 of the embodiment of the present invention can be fabricated on the glass, that is, COG (circuit on glass), or can be fabricated outside the glass, for example, on a flexible printed circuit (FPC) or printed circuit board (PCB).

Figure 3B:
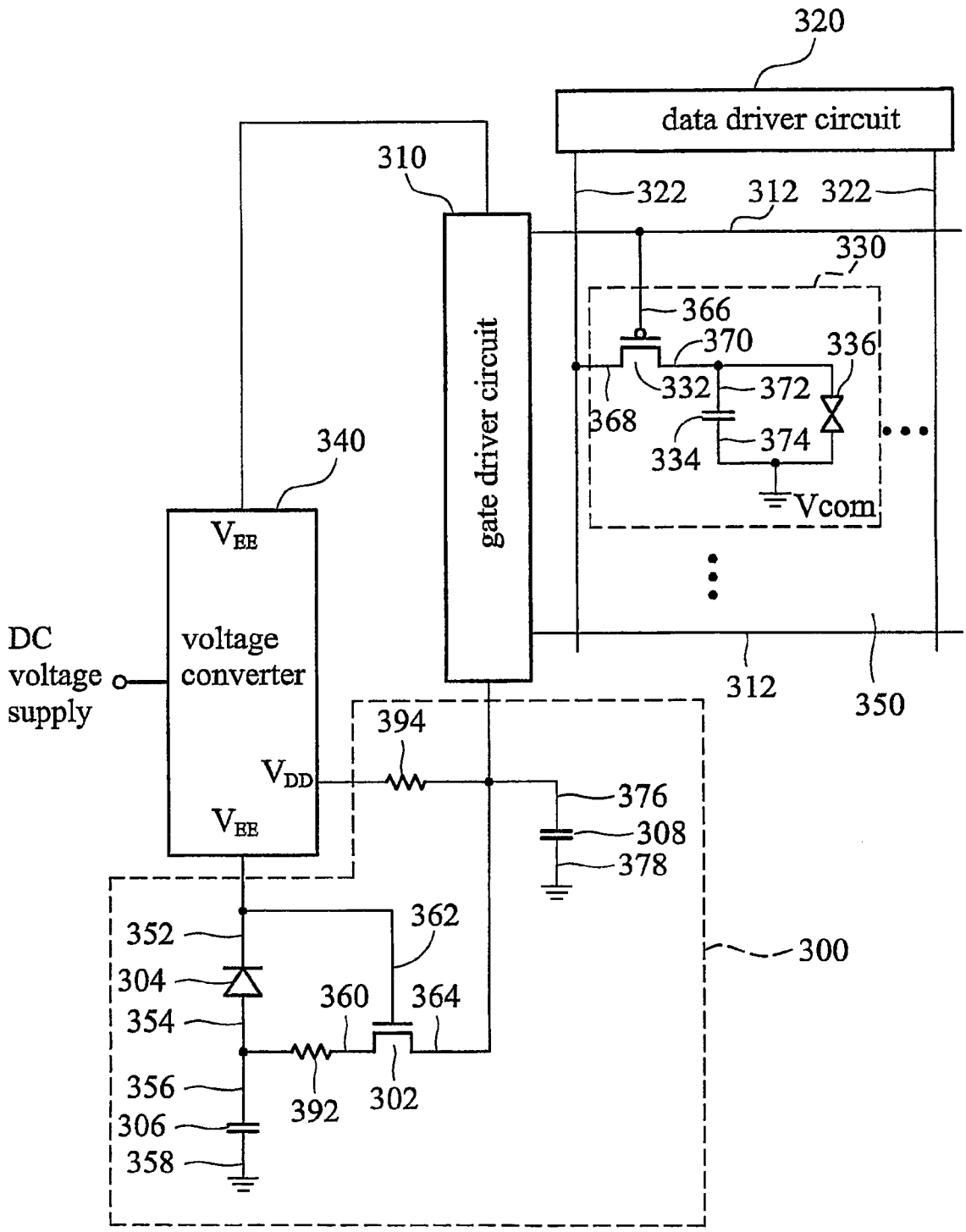
FIG. 3B shows a variation of the image sticking prevention circuit according to one embodiment of the invention shown in FIG. 3A.

FIG. 3B shows an image sticking prevention circuit in accordance with a modification of the embodiment of the present invention shown in FIG. 3A. FIG. 3B differs from FIG. 3A in that the transistor 302 is an NMOS transistor rather than a PMOS transistor, the driving transistor 332 is a PMOS transistor, and the first terminal 352 of the diode 304 is a cathode. Further, the first and second voltage terminals of voltage converter 340 provide a negative voltage $V_{EE}$ and a positive voltage $V_{DD}$, respectively. The first voltage terminal $V_{EE}$ of the voltage converter 340 is coupled to the first terminal 352 of the diode 304. The second terminal 354 of the diode 304 is coupled to the first terminal 356 of the first capacitor 306. The second voltage terminal $V_{DD}$ of the voltage converter 340 is coupled to the resistor 394.

When the voltage converter 340 supplies power, the transistor 302 is turned off and the diode 304 is forward biased. Hence, the voltage level of the first terminal 356 of the first capacitor 306 is approximately the same as that of the first voltage terminal $V_{EE}$. When the voltage converter 340 does not supply the power, the voltage level of the first terminal 356 of the first capacitor 106 is negative and the gate voltage of the transistor 302 is 0V. Hence the transistor 302 is turned on and the driving transistor 332 is turned on by discharge of the first capacitor 306. Therefore, the image charge stored in the storage capacitor 334 is released to the data line 322 via the driving transistor 332.

Figure 3C:
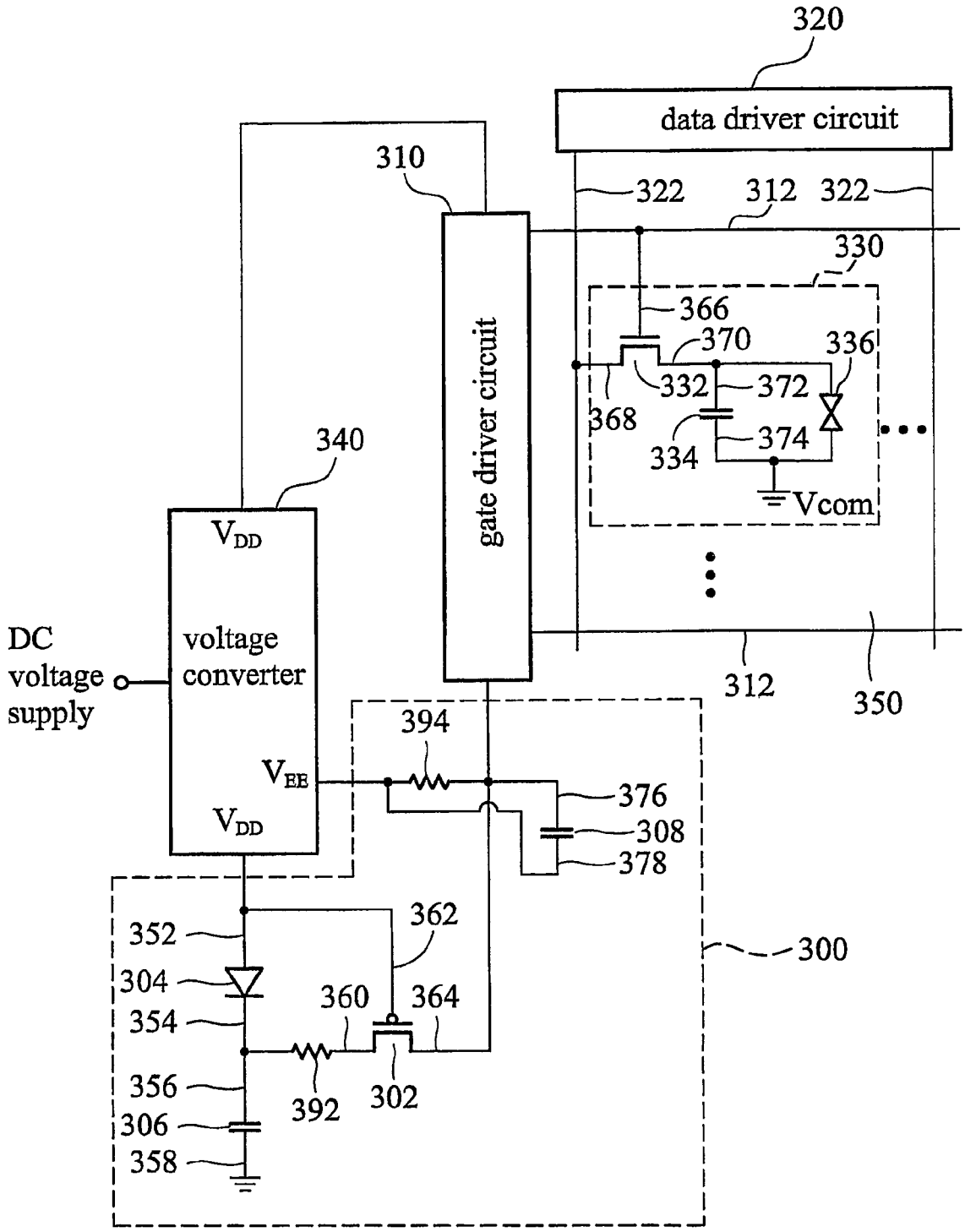
FIG. 3C shows another variation of the image sticking prevention circuit according to one embodiment of the invention shown in FIG. 3A.
Figure 3D:
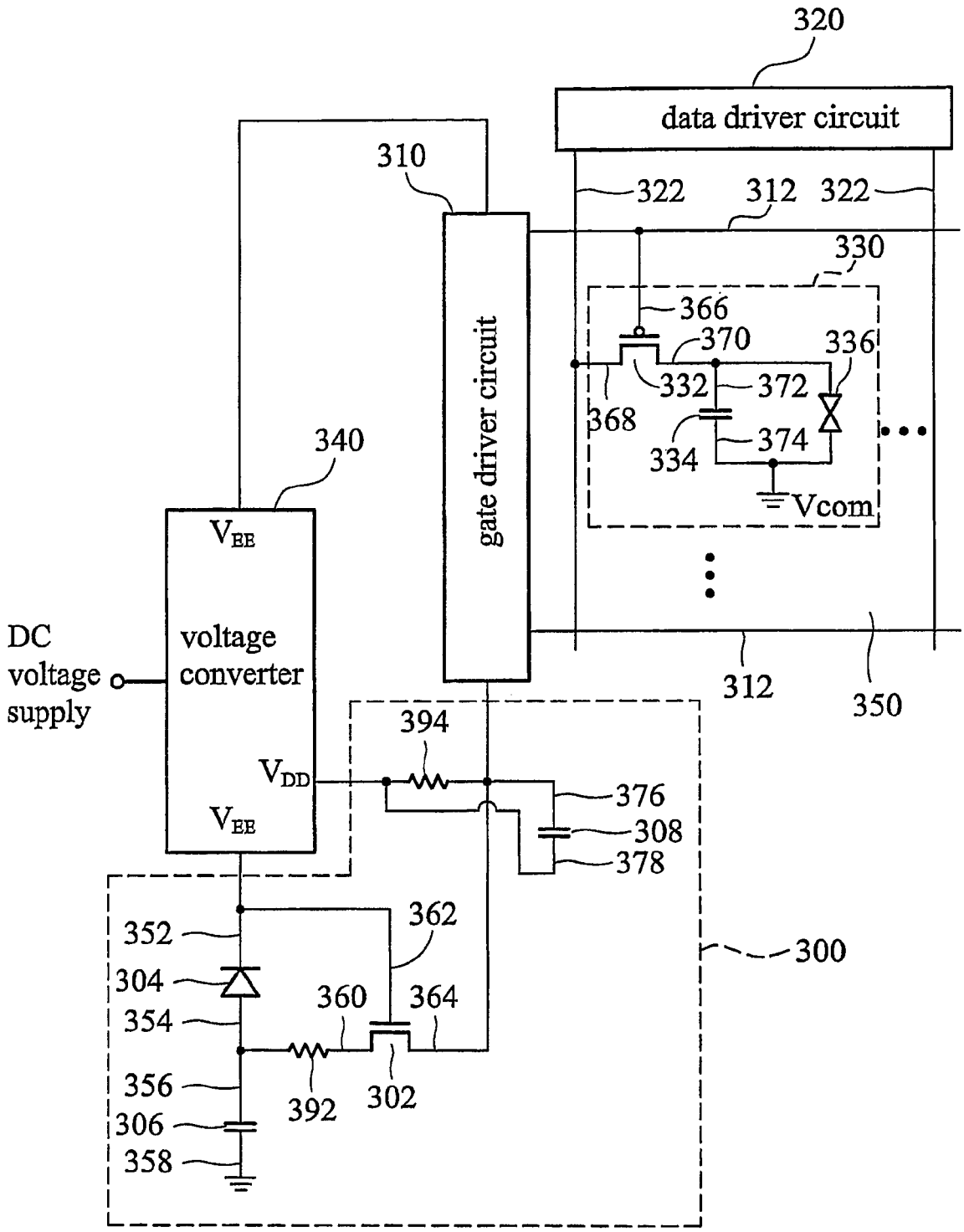
FIG. 3D shows a variation of the image sticking prevention circuit according to one embodiment of the invention shown in FIG. 3B.

FIG. 3C shows a variation of the image sticking prevention circuit according to the embodiment of the invention shown in FIG. 3A. FIG. 3C differs from FIG. 3A in that the second terminal 378 of the second capacitor 308 is coupled to the second voltage terminal $V_{EE}$ of the voltage converter 340. FIG. 3D shows a variation of the image sticking prevention circuit according to the embodiment of the invention shown in FIG. 3B. FIG. 3D differs from FIG. 3B in that the second terminal 378 of the second capacitor is coupled to the second voltage terminal $V_{DD}$ of the voltage converter 340.

Figure 4A:
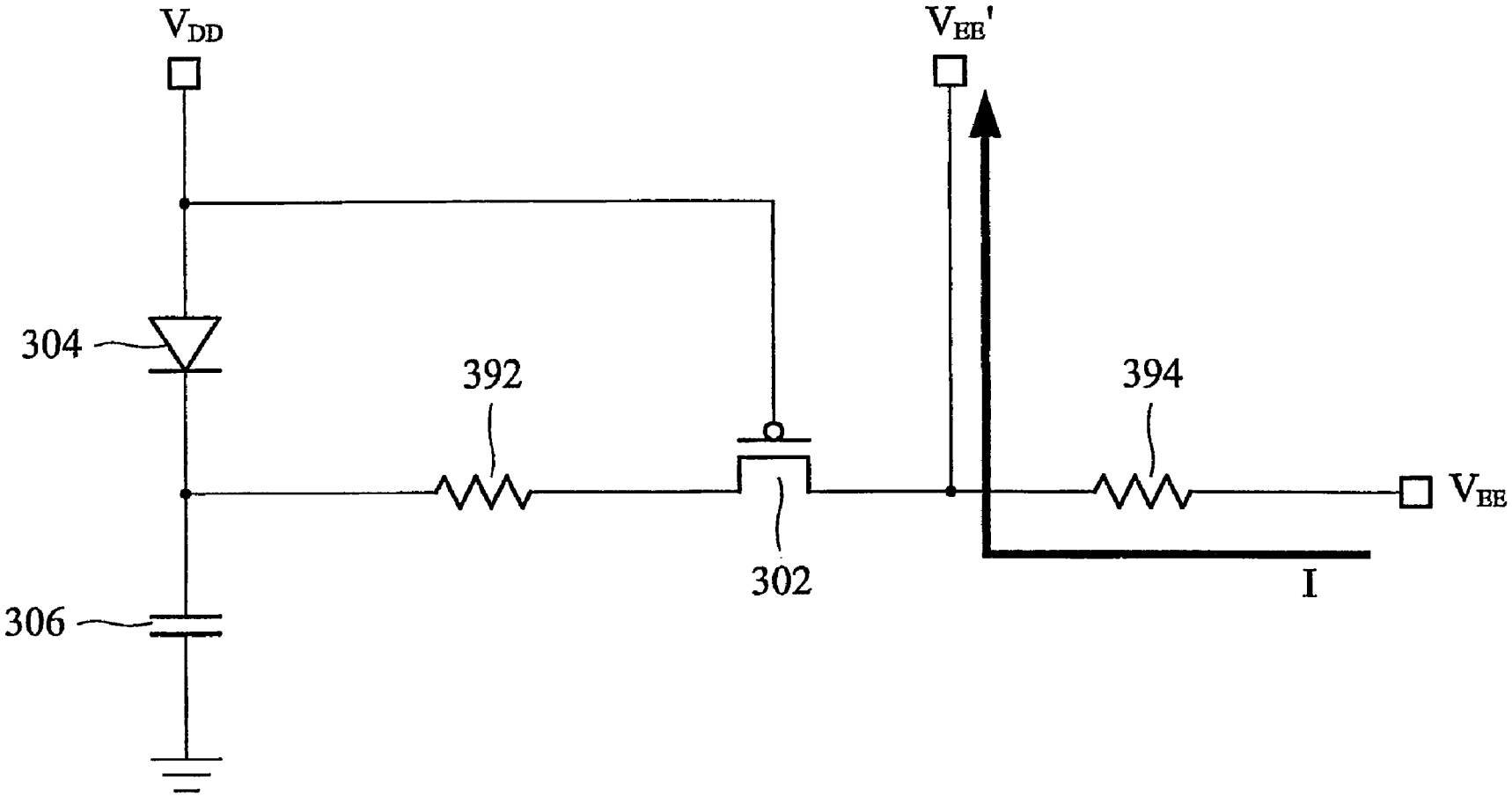
FIG. 4A is a schematic diagram of an image sticking prevention circuit without a second capacitor when a display is in a normal mode.
Figure 4B:
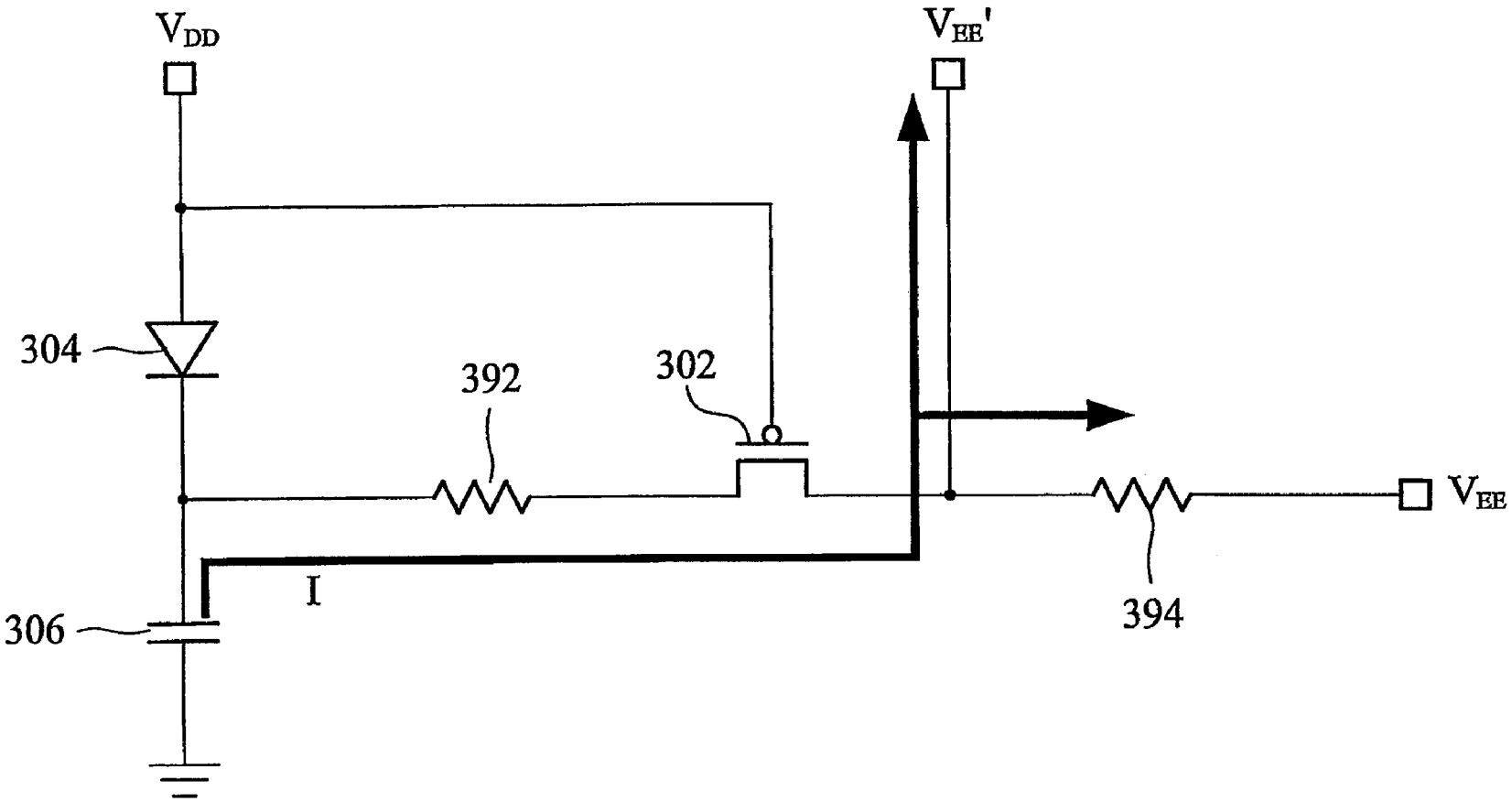
FIG. 4B is a schematic diagram of an image sticking prevention circuit without a second capacitor when a display is in a power-off mode.

FIG. 4A is a simplified schematic diagram of an image sticking prevention circuit 300 according to FIG. 3A, however, without the second capacitor 308 when a display is in a normal mode. When a resolution of the display is higher, the second terminal $V_{EE}$ of the voltage converter 340 supplies more current I to the display. If resistance of the resistor 394 is high, the current I provided by the second terminal $V_{EE}$ of the voltage converter 340 is limited, thus limiting the driving capability of the second terminal $V_{EE}$ of the voltage converter 340. As a result, current leakage in the driving transistor 332 degrades display quality. FIG. 4B is a simplified schematic diagram of an image sticking prevention circuit 300 according to FIG. 3A, however, without a second capacitor 308 when a display is in a power-off mode. The charge stored in the first capacitor 306 is discharged through the resistor 392 and the transistor 302. One current path leads to the second terminal $V_{EE}$ of the voltage converter 340 and the other to a terminal $V_{EE}'$ of the gate driver circuit 310. If the resistance of the resistor 394 is low, current through the resistor 394 is significant, and charge stored in the storage capacitor 334 in the pixel array 350 cannot be discharged effectively. As a result, image sticking may still occur.

Figure 4C:
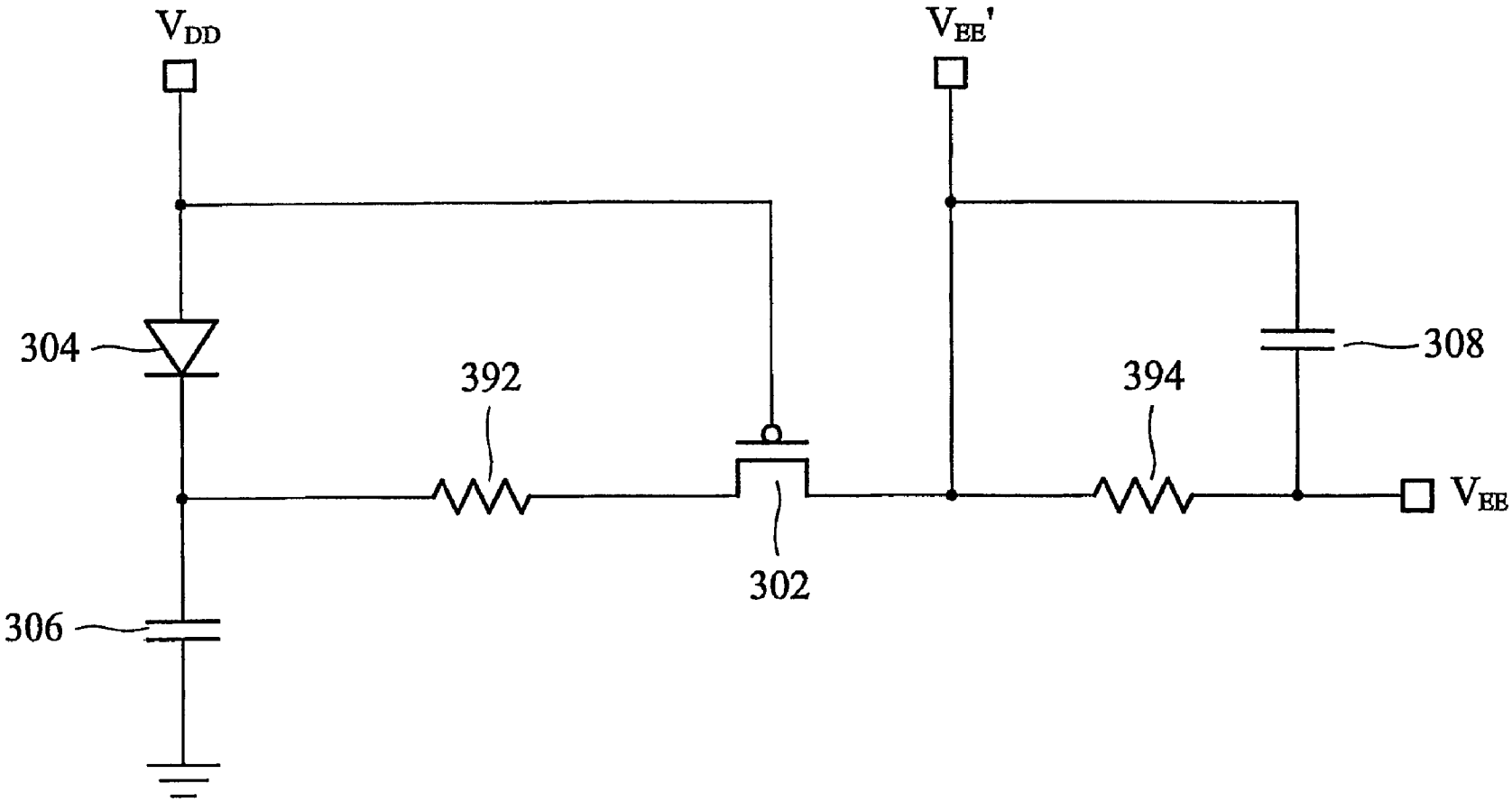
FIG. 4C is a schematic diagram of an image sticking prevention circuit with a second capacitor.

FIG. 4C is a simplified schematic diagram of a sticking prevention circuit 300 according to FIG. 3A, comprising a second capacitor 308. Preferably, the capacitance of the second capacitor 308 can be 0.1 μF to 10 μF. In normal mode, even if the resistance of the resistor 394 is high, the second capacitor 308 stabilizes the voltage of the second terminal $V_{EE}$ of the voltage converter 340, improving the driving capability thereof. In the power-off mode, the high resistance of the resistor 394 impedes current path to the second terminal $V_{EE}$ of the voltage converter 340. The charge stored in the storage capacitors 334 in the pixel array 350 is discharged effectively and thus image sticking is prevented. In addition, only a small amount of charge is absorbed by the second capacitor 308 due to the small capacitance thereof and thus it has negligible impact on image sticking prevention.

The voltage converter 340 of the present invention can be, but is not limited to, a DC-to-DC converter, and the transistor 332 can be, but is not limited to, an LTPS-TFT. The voltage converter 340 coupled to a DC voltage supply converts the DC voltage to the DC voltage required by the circuits in the display.

Figure 5:
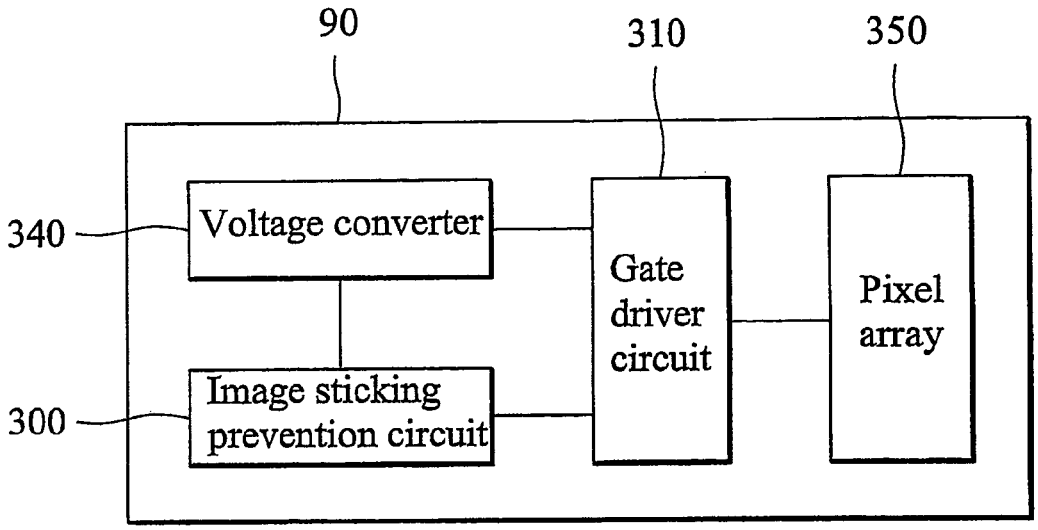
FIG. 5 is a schematic diagram illustrating a display device incorporating an image sticking prevention circuit in accordance with one embodiment of the present invention.

FIG. 5 is a schematic diagram illustrating a display device incorporating an image sticking prevention circuit in accordance with one embodiment of the present invention. A display device 90 comprises an image sticking prevention circuit 300 coupled between a voltage converter 340 and a gate driver circuit 310 and the gate driver circuit 310 is connected to a pixel array 350. The voltage converter 340 converts input voltage into a desired voltage to operate the gate driver circuit 310. When a DC voltage is supplied to the voltage converter 340, the converted voltage is directed to the gate driver circuit 310. However, when the display device 90 enters a power-off mode, the image sticking prevention circuit 300 can release the stored charge of the pixel array 350.

Figure 6:
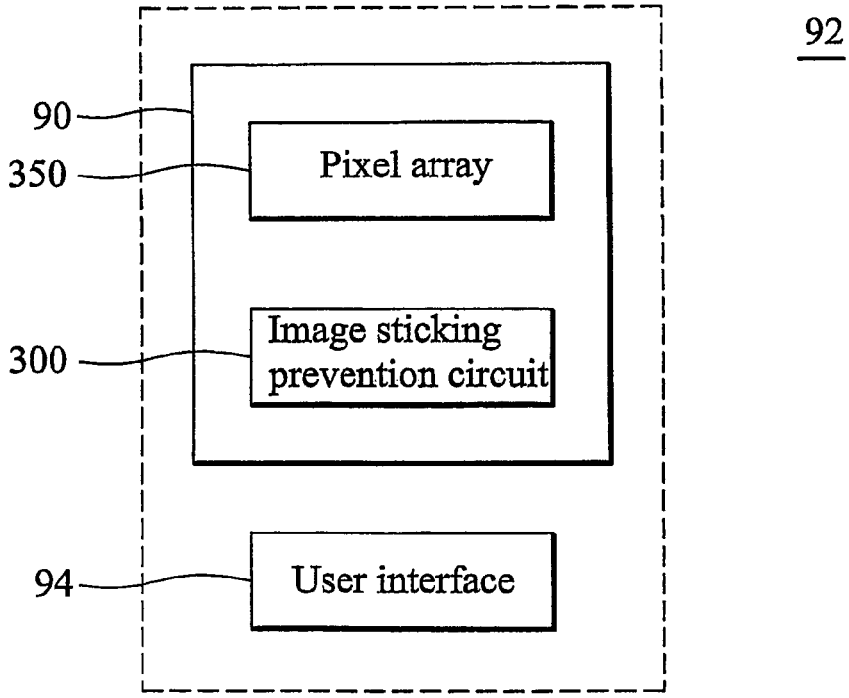
FIG. 6 schematically shows an electronic device having an image sticking prevention circuit in accordance with one embodiment of the present invention.

FIG. 6 schematically shows an electronic device 92 deploying a display device 90 having an image sticking prevention circuit 300 as disclosed above. The electronic device 92 may be a portable device such as PDA, notebook computer, tablet computer, cellular phone, display monitor device, or other. Generally, the electronic device 92 comprises a display device 90 and a user interface 94, etc. The display device 90 comprises the image sticking prevention circuit 300 and the pixel array 350. Further, the user interface 94 has a switch (not shown) to power on the pixel array 350. Once the electronic device 92 enters a power-off mode, the image sticking prevention circuit 300 can help to drain away the residual charge stored in the pixel array 350.

In summary, the image sticking prevention circuit of the present invention does not require adjustment of the I-V curve of the driving transistor and avoids current leakage, thereby not affecting display performance. When the display enters a power-off mode, the residual charge stored in the first capacitor raises the gate line to a high voltage level and turns on the driving transistor in the pixel driving circuit. Image charge stored in the first capacitor is thus released, preventing image sticking. The second capacitor aids driving capability of the second voltage terminal of the voltage converter during normal mode and efficiency of image sticking prevention during power-off mode.

While the invention has been described by the way of example and in terms of preferred embodiment, it is to be understood that the invention is not limited thereto. To the contrary, it is intended to cover various modifications and would be apparent to those skilled in the art. Therefore, the scope of the appended claims should be accorded the broadest interpretation so as to encompass all such modifications.

What is claimed is:

1. An image sticking prevention circuit for a power-off mode of a display, the image sticking prevention circuit comprising:

a diode having a first terminal and a second terminal, the first terminal of the diode coupled to a first voltage terminal of a voltage converter;

a first capacitor having a first terminal coupled to the second terminal of the diode and a second terminal coupled to a first fixed potential;

a transistor having a first terminal coupled to the first terminal of the first capacitor, a second terminal coupled to the first terminal of the diode and the first voltage terminal of the voltage converter, and a third terminal coupled to a gate driver circuit and a second voltage terminal of the voltage converter; and a second capacitor having a first terminal coupled to the third terminal of the transistor and a second terminal coupled to a second fixed potential.

2. The image sticking prevention circuit of claim 1, wherein the transistor is a PMOS transistor and the first terminal of the diode is an anode thereof.

3. The image sticking prevention circuit of claim 2, wherein the first voltage terminal of the voltage converter provides a positive voltage.

4. The image sticking prevention circuit of claim 3, wherein the second fixed potential is the second voltage terminal of the voltage converter.

5. The image sticking prevention circuit of claim 1, wherein the transistor is a NMOS transistor and the first terminal of the diode is a cathode thereof.

6. The image sticking prevention circuit of claim 5, wherein the first voltage terminal of the voltage converter provides a negative voltage.

7. The image sticking prevention circuit of claim 6, wherein the second fixed potential is the second voltage terminal of the voltage converter.

8. The image sticking prevention circuit of claim 1, wherein the second fixed potential is the first fixed potential.

9. The image sticking prevention circuit of claim 1, wherein the first fixed potential is a ground.

10. The image sticking prevention circuit of claim 1, wherein the voltage converter is a DC-to-DC converter.

11. The image sticking prevention circuit of claim 1, wherein the display is a liquid crystal display.

12. The image sticking prevention circuit of claim 1, wherein a capacitance of the second capacitor is 0.1 μF to 10 μF.

13. An integrated circuit comprising the image sticking prevention circuit of claim 1.

14. A display device, comprising:

a pixel array;

a gate driver circuit coupled to the pixel array;

a voltage converter coupled to the gate driver circuit; and an image sticking prevention circuit of claim 1 coupled to the gate driver circuit and the voltage converter.

15. An electronic device, comprising:

a display device of claim 14; and a user interface operatively coupled to the display device to control the display device.

* * * * *